US006167846B1

(12) United States Patent
Ogino et al.

(10) Patent No.: US 6,167,846 B1
(45) Date of Patent: Jan. 2, 2001

(54) CATALYTIC COMBUSTION HEATER

(75) Inventors: Shigeru Ogino, Toyota; Tomoji Yamada, Kariya; Shoji Hirose, Nagoya, all of (JP)

(73) Assignee: Toyota Jidosha Kabushiki Kaisha, Toyota (JP)

( * ) Notice: Under 35 U.S.C. 154(b), the term of this patent shall be extended for 0 days.

(21) Appl. No.: 09/292,846

(22) Filed: Apr. 16, 1999

(30) Foreign Application Priority Data

May 14, 1998 (JP) ..... 10-152133
May 14, 1998 (JP) ..... 10-152134
Jun. 1, 1998 (JP) ..... 10-169339

(51) Int. Cl.[7] ..... F22B 23/06
(52) U.S. Cl. ..... 122/367.1; 122/367.3; 122/4 D
(58) Field of Search ..... 122/4 D, 367.1, 122/367.2, 367.3; 165/901, 146

(56) References Cited

U.S. PATENT DOCUMENTS 2,778,610 * 1/1957 Bruegger ..... 122/4 D
2,878,789 * 3/1959 Huet ..... 122/4 D
2,898,201 * 8/1959 Hayes ..... 122/4 D
2,902,265 * 9/1959 Dubovick ..... 165/901
2,997,031 * 8/1961 Ulmer ..... 122/4 D
3,048,153 * 8/1962 Abrahamsen ..... 122/4 D
3,073,575 * 1/1963 Schulenberg ..... 165/146
3,110,300 * 11/1963 Brown et al. ..... 122/4 D
3,119,378 * 1/1964 Marshall ..... 122/4 D
3,618,572 * 11/1971 Nauert ..... 122/367.1
3,813,039 * 5/1974 Wells ..... 237/55
4,034,803 * 7/1977 Reed et al. ..... 165/103
4,056,143 * 11/1977 Martin ..... 165/176
4,165,783 * 8/1979 Oplatka ..... 165/110
4,201,263 * 5/1980 Anderson ..... 165/146
5,632,329 * 5/1997 Fay ..... 165/113
5,746,159 * 5/1998 Kobayashi et al. ..... 122/367.1

FOREIGN PATENT DOCUMENTS 5-223201 8/1993 (JP) .
6-249414 9/1994 (JP) .

* cited by examiner

*Primary Examiner*—Denise L. Ferensic
*Assistant Examiner*—Jiping Lu
(74) *Attorney, Agent, or Firm*—Oblon, Spivak, McClelland, Maier & Neustadt, P.C.

(57) ABSTRACT

Multiple heat-receiving fluid passages, through which heat-receiving fluid flows, are arranged in layers in a fuel gas passage provided in a container. Multiple fins, on which an oxidation catalyst is carried, are provided on outer peripheries of the heat-receiving fluid passages. A feed port for combustion support gas is provided at one end of the fuel gas passage, and multiple combustible gas feed ports are provided in a wall of the fuel gas passage. Combustible gas is separately supplied to the respective layers of the heat-receiving fluid passages in accordance with a state of the heat-receiving fluid so as to suitably control a heat release value. Especially in the intermediate layer where the heat-receiving fluid is at its boiling point and thus exhibits a low heat transfer resistance, more combustible gas feed ports are provided than in the other layers. As a result, more fuel is supplied, the heat release value is increased, and the heat exchange efficiency is enhanced.

20 Claims, 5 Drawing Sheets

CATALYTIC COMBUSTION HEATER

The disclosures of Japanese Patent Applications No. HEI 10-169339 filed on Jun. 1, 1998, No. HEI 10-152134 filed on May 14, 1998 and No. HEI 10-152133 filed on May 14, 1998, including the specifications, drawings and abstracts are incorporated herein by reference in their entirety.

BACKGROUND OF THE INVENTION

1. Field of the Invention

The present invention relates to a catalytic combustion heater that causes an oxidation reaction of fuel gas using a catalyst and heats heat-receiving fluid by means of heat generated in the oxidation reaction.

2. Description of the Related Art

In a known catalytic combustion heater, combustible gas (fuel gas) is burnt using an oxidation catalyst, and a heat-receiving fluid is heated by means of the heat generated. It is expected that such a catalytic combustion heater will be applied to a variety of uses, for example, in houses, automobiles and the like. A catalytic combustion heater of this type is usually provided with a catalyst-based heat exchanger wherein tubes in which heat-receiving fluid flows are disposed in a fuel gas passage and multiple catalyst-carrying fins are integrally bonded to outer peripheries of the heat-receiving fluid passages. Carried on an outer surface of each of the catalyst-carrying fins is an oxidation catalyst such as platinum, palladium or the like. Fuel gas is brought into contact with these fins so as to cause an oxidation reaction.

FIG. 9 shows an example of such a catalyst combustion heater. Referring to FIG. 9, a catalyst-based heat exchanger is disposed in a container 100. The catalyst-based heat exchanger is composed of a plurality of tubes 102 hung across left and right lateral walls and multiple fins 104 bonded to outer peripheries of the tubes 102. An oxidation catalyst is carried on a surface of each of the fins 104. The tubes 102 are connected with one another at their left and right end portions, and form a continuous heat-receiving fluid passage therein. Upper and lower end openings of the heat-receiving fluid passage serve as inlet and outlet ports for the heat-receiving fluid respectively. A heat-receiving fluid, which is liquid, flows through the passage formed in the tubes 102 in a top-to-bottom direction in the drawing. Meanwhile, the heat-receiving fluid is heated, reaches its boiling point and becomes gaseous.

Provided at lower and upper end portions of the container 100 are a fuel gas feed port 106 and a fuel gas exhaust port 108 respectively. Fuel gas flows among the fins provided on the outer peripheries of the tubes 102 in a bottom-to-top direction in the drawing. Upon contact with the surfaces of the fins 104 on which the oxidation catalyst is carried, the fuel gas burns due to a catalytic reaction. The heat generated by catalytic combustion is transmitted to the heat-receiving fluid flowing in the tubes 102 through the walls thereof. After catalytic combustion, exhaust gas is discharged out of the container 100 through the exhaust port 108. A current plate 110 having multiple perforations is disposed above the feed port 106 and across the fuel gas passage. Disposed above the current plate 110 is a heater 112 for heating the catalyst to a temperature equal to or higher than its activation temperature.

In the aforementioned catalytic combustion heater, while burning, fuel gas flows in the container 100 in the bottom-to-top direction in the drawing. On the other hand, while being heated, the heat-receiving fluid in its liquid state flows in the container 100 contrary to the flow of fuel gas, that is, in the top-to-bottom direction in the drawing. Thus, in the case where fuel gas and heat-receiving fluid flow in opposite directions, on the downstream side of the fuel gas passage, the heat-receiving fluid is at a low temperature in the vicinity of the fuel gas exhaust port 108. Therefore, the heat of combustion exhaust gas is transmitted to the heat-receiving fluid of a lower temperature with a view to utilizing the generated heat more effectively.

However, on the upstream side of the fuel gas passage, fuel gas of the highest concentration keeps flowing into the tubes 102 in the vicinity of the fuel gas feed port 106, that is, the tubes 102 through which the heat-receiving fluid in its gaseous state flows. When the heat-receiving fluid is gaseous, it exhibits its highest temperature and a low heat transfer rate. In other words, a large amount of heat is generated in a section with the highest heat transfer resistance. Hence, the fins 104 carrying the oxidation catalyst or the tubes 102 through which heat-receiving fluid flows tend to be overheated, which may adversely affect the catalytic combustion heater.

Further, in order to enhance heat exchange efficiency, heat exchange between fuel gas and the fins 104 or the tubes 102 needs to be avoided to the maximum possible extent. However, on the upstream side of the fuel gas passage, the heat transfer resistance to the heat-receiving fluid is high. Thus, the heat generated is transmitted to fuel gas and there arises a tendency for the combustion exhaust gas to reach a high temperature. In general, on the grounds that gas and metal exhibit a low heat transfer rate and that catalytic combustion occurs at a lower temperature than flame combustion, it is difficult to recover the heat that has been transmitted to the fuel gas. An attempt to enhance heat exchange efficiency causes an inconvenience of enlarging the size of the catalytic combustion heater.

SUMMARY OF THE INVENTION

In view of the above-described background, the present invention has been conceived. It is an object of the present invention to provide a catalytic combustion heater that suitably adjusts a heat release value resulting from a catalytic reaction, prevents the fins and tubes (heat-receiving fluid passage) from being overheated, and achieves great security as well as high heat exchange efficiency.

In order to achieve the aforementioned object, according to a first aspect of the present invention, there is provided a catalytic combustion heater constructed as follows. That is, the catalytic combustion heater includes a container forming a fuel gas passage, heat-receiving fluid passages in which heat-receiving fluid flows, a catalyst-based heat exchanger and heat amount changing means. The heat-receiving fluid passages are disposed in the fuel gas passage. The catalyst-based heat exchanger is designed to heat a heat-receiving fluid by means of reaction heat of fuel gas. The catalyst-based heat exchanger is disposed in the fuel gas passage and has catalytic layers that are provided on outer peripheries of the heat-receiving fluid passages and cause an exothermic reaction upon contact with fuel gas. The heat amount changing means is designed to change an amount of heat to be supplied to heat-receiving fluid flowing in respective portions of the heat-receiving fluid passages, in accordance with a state of the heat-receiving fluid.

The aforementioned heat amount changing means may have fuel distribution means for separately supplying fuel gas to the respective portions of the heat-receiving fluid passages in accordance with a state of the heat-receiving fluid flowing inside.

The present invention focuses attention on the facts that most of the heat necessary for liquid heat-receiving fluid to be heated to a high temperature and converted into its gaseous state is evaporative latent heat and that when the heat-receiving fluid is at its boiling point, the heat transfer rate from the inner wall surface of the heat-receiving fluid passage to the heat-receiving fluid is much higher than in the case where gasified heat-receiving fluid is heated. Therefore, the aforementioned fuel distribution means is used to separately supply fuel gas in accordance with a state of the heat-receiving fluid flowing inside. Consequently, it is possible to achieve effective heat transmission without enlarging the size of the heat exchanger.

In the first aspect of the present invention, the fuel distribution means may be designed to separately supply fuel gas in a larger amount to a section where the heat-receiving fluid is at its boiling point, than to the other sections.

Especially, in the catalyst-based heat exchanger, more fuel gas is supplied to a section that necessitates most heat and is most sensitive to heat, than the other sections. Hence, the heat release value of that section can be increased. Thus, it is possible to achieve efficient heat transmission without enlarging the size of the heat exchanger. Furthermore, for example, the amount of fuel gas to be supplied to a section where the heat-receiving fluid is gaseous and at a high temperature is reduced, so as to prevent the heat release value of that section from becoming too large. Therefore, it is possible to prevent the heat-receiving fluid passages from being overheated and to thereby enhance the overall security. In this manner, it is possible to realize a catalytic combustion heater that is compact, safe and high in heat exchange efficiency.

In the first aspect of the present invention, the heat-receiving fluid passages may be designed to have an exothermic area per unit length that is larger in the section where the heat-receiving fluid flowing in the heat-receiving fluid passages is at its boiling point, than in the other sections. For example, multiple fins are provided on outer peripheries of the heat-receiving fluid passages, and the fins are bonded to that section over a smaller area than the other sections. Hence, in a section that necessitates a large amount of heat, is sensitive to heat and allows heat-receiving fluid at its boiling point to flow therethrough, the amount of heat generated can be increased. Accordingly, with a simple structure, the heat release value can be adjusted suitably and high heat exchange efficiency can be accomplished. Also, the fins may be larger in size in the section where heat-receiving fluid is at its boiling point than in the other sections. Alternatively, in a section where heat-receiving fluid is at its boiling point, the fins may be larger in size and arranged at smaller intervals than in the other sections.

In the first aspect of the present invention, the catalytic combustion heater may be provided with temperature detection means and fuel reduction means. The temperature detection means detects a temperature of heat-receiving fluid and is provided in a section where the heat-receiving fluid should constantly remain at its boiling point. The fuel reduction means reduces an amount of fuel gas to be supplied to the aforementioned section when it has been determined from a temperature of heat-receiving fluid detected by the temperature detection means that the heat-receiving fluid in that section is gaseous.

The present invention is designed such that a large amount of heat is generated in the section where the heat-receiving fluid is at its boiling point. Therefore, if the heat-receiving fluid has been gasified completely in a section where the heat-receiving fluid should intrinsically be at its boiling point, due to an abrupt change in flow rate or the like, the generated heat is not transmitted to the heat-receiving fluid. As a result, there is a possibility that the heat-receiving fluid passages or the fins are overheated. In view of this, the temperature detection means is used to detect a temperature of the heat-receiving fluid in that section. If it is determined that the heat-receiving fluid has been gasified completely, the amount of fuel gas to be supplied is reduced. In this manner, the heat release value can be reduced, the heat-receiving fluid passages or the fins can be prevented from being overheated, and further enhancement in security can be achieved.

In the first aspect of the present invention, the fuel distribution means may have multiple fuel feed ports for separately supplying fuel gas to respective portions of the heat-receiving fluid passages, the fuel feed ports being formed in a wall of the fuel gas passage. The fuel feed ports may have a total cross-sectional area that is larger in a section where heat-receiving fluid is at its boiling point than at the other sections.

More specifically, fuel gas is supplied to the fuel gas passage through multiple fuel gas feed ports formed in the wall of the fuel gas passage, whereby it becomes possible to supply a required amount of fuel gas to respective portions of the heat-receiving fluid passages. Then, for example, more fuel gas feed ports are formed in the section where the heat-receiving fluid is at its boiling point, than in the other sections, and the total area of the fuel gas feed ports in that section is enlarged. Accordingly, with such a simple structure, the heat release value in that section can be increased.

Further, in the first aspect of the present invention, the oxidation catalytic layers may be composed of fins on which an oxidation catalyst is carried.

Further, in the first aspect of the present invention, the fins may be arranged at smaller intervals in a section where the heat-receiving fluid flowing in the heat-receiving fluid passages is at its boiling point, than in the other sections.

Still further, in the first aspect of the present invention, the catalyst-based heat exchanger may heat the heat-receiving fluid in its liquid state and makes the heat-receiving fluid gaseous.

Still further, in the first aspect of the present invention, the heat-receiving fluid in the catalyst-based heat exchanger may be designed to flow in a direction opposite to the flow of fuel gas.

According to a second aspect of the present invention, the catalytic combustion heater of the first aspect may be constructed as follows. That is, the fuel gas includes combustible gas and combustion support gas, and the fuel distribution means makes inhomogeneous a mixture state of the combustible gas and the combustion support gas included in the fuel gas supplied to the peripheries of the heat-receiving fluid passages in a region of the fuel gas passage where the heat-receiving fluid flowing in the heat-receiving fluid passages exhibits a high heat transfer resistance.

According to the aforementioned construction, in the region where the heat-receiving fluid exhibits a high heat transfer resistance, fuel gas, which is the inhomogeneous mixture of combustible gas and combustion support gas (normally air), is supplied to the catalytic layers provided on the outer peripheries of the heat-receiving fluid passages. Accordingly, that region undergoes partial deficiency in oxygen, and the heat release value thereof is reduced. Consequently, the heat release value on the outer surfaces of the heat-receiving fluid passages is balanced with the amount of heat transmitted to the heat-receiving fluid. Thus, the generation of an excessive amount of heat can be inhibited, the outer surfaces of the heat-receiving fluid passages can be prevented from being overheated, and high heat exchange efficiency can be achieved.

In the second aspect of the present invention, the fuel distribution means may be composed of a feed portion of the combustion support gas that is provided at an upstream end portion of the fuel gas passage and a feed portion of combustible gas that opens in proximity to an upstream side of the heat-receiving fluid passages corresponding to the region where heat-receiving fluid exhibits a high heat transfer resistance.

In this manner, due to the construction wherein the inlet ports for combustion support gas and combustible gas are separately provided and combustion support gas and combustible gas are separately introduced into the fuel gas passage, the mixture state of combustion support gas and combustible gas can be made inhomogeneous. Especially, because the inlet port for combustible gas is provided on the upstream side in the vicinity of the region where heat-receiving fluid exhibits a high heat transfer resistance, the heat release value of that region can be reduced so as to achieve effective heat exchange.

According to a third aspect of the present invention, the catalytic combustion heater of the first aspect may be constructed as follows. That is, the fuel gas includes combustible gas and combustion support gas, and the fuel distribution means makes homogeneous a mixture state of the combustible gas and the combustion support gas included in the fuel gas supplied to the peripheries of the heat-receiving fluid passages in a region of the fuel gas passage where the heat-receiving fluid flowing in the heat-receiving fluid passages exhibits a low heat transfer resistance.

In the aforementioned construction, in the region where the heat-receiving fluid exhibits a low heat transfer resistance, fuel gas, which is the homogeneous mixture of combustible gas and combustion support gas, is supplied to the catalytic layers provided on the outer peripheries of the heat-receiving fluid passages. As a result, the combustion efficiency and heat release value can be increased in that region. In the region where heat-receiving fluid exhibits a low heat transfer resistance, for example, in the region where the heat-receiving fluid is at its boiling point and in liquid and gaseous phases, the heat transfer rate is high. Hence, by increasing a heat release value, the efficiency of heat transfer to the heat-receiving fluid is enhanced and high heat exchange efficiency is achieved. Further, since combustion is facilitated, it is possible to inhibit unburnt gas from being discharged, and even upon activation of the heater, low-emission operation can be performed.

In the third aspect of the present invention, the means for making homogeneous the mixture state of the fuel gas may be a diffuser member having multiple perforations. The diffuser member is disposed across the fuel gas passage in proximity to an upstream side of the heat-receiving fluid passages corresponding to the region where heat-receiving fluid exhibits a low heat transfer resistance.

This diffuser member promotes the mixing of combustion support gas with combustible gas, whereby it becomes possible to supply fuel gas of enhanced homogeneity to the region where the heat-receiving fluid exhibits a low heat transfer resistance.

In the second and third aspects of the present invention, the heat-receiving fluid in the catalyst-based heat exchanger may be designed to flow in a direction opposite to the flow of fuel gas. In this case, the above-described overheat prevention effect can be achieved more remarkably.

According to a fourth aspect of the present invention, there is provided a catalytic combustion heater constructed as follows. That is, the catalytic combustion heater includes a container forming a fuel gas passage, heat-receiving fluid passages in which heat-receiving fluid flows, and a catalyst-based heat exchanger. The heat-receiving fluid passages are disposed in the fuel gas passage. The catalyst-based heat exchanger heats the heat-receiving fluid by means of reaction heat of fuel gas. The heat exchanger has catalytic layers that are provided on outer peripheries of the heat-receiving fluid passages and cause an exothermic reaction upon contact with fuel gas. A large number of the heat-receiving fluid passages are disposed across the fuel gas passage, and heat-receiving fluid in a passage connecting the heat-receiving fluid passages with one another flows in a direction opposite to the flow of fuel gas. The heat-receiving fluid passages are smaller in diameter on an upstream side of the fuel gas passage where the heat-receiving fluid is gaseous than on a downstream side of the fuel gas passage where the heat-receiving fluid is liquid or at its boiling point, and the heat-receiving fluid passages are arranged more densely on the upstream side than on the downstream side.

In the aforementioned construction, on the upstream side of the fuel gas passage where the heat-receiving fluid is gaseous and at a high temperature, the catalytic layers are formed instead of bonding the fins to the peripheries of the heat-receiving fluid passages. Thus, the heat release value resulting from exothermic reaction of catalyst does not become too large. In addition, the fins and the heat-receiving fluid passages can be prevented from being overheated, and the overall security can be enhanced. Still further, on the upstream side where heat-receiving fluid is gaseous, the heat transfer resistance to the heat-receiving fluid passages is higher than on the downstream side. Therefore, even with a low heat release value, the outer surfaces of the heat-receiving fluid passages are maintained at a relatively high temperature. Accordingly, the catalyst is directly carried on the outer surfaces of the heat-receiving fluid passages, so that the catalyst can be activated sufficiently.

Furthermore, the heat-receiving fluid passages on the upstream side are not provided with the fins. Hence, on the upstream side where fuel gas of a low temperature is supplied, there is little possibility of the fins functioning as cooling lines. On the other hand, on the downstream side of the fuel gas passage, the fins are provided on the peripheries of the heat-receiving fluid passages. Thus, a large exothermic area is ensured, whereby a sufficient amount of heat is generated. Consequently, taking advantage of the difference in temperature, the heat exchange efficiency can be enhanced.

According to a fifth aspect of the present invention, there is provided a catalytic combustion heater constructed as follows. That is, the catalytic combustion heater includes a container forming a fuel gas passage, heat-receiving fluid passages in which heat-receiving fluid flows, and a catalyst-based heat exchanger. The heat-receiving fluid passages are disposed in the fuel gas passage. The catalyst-based heat exchanger is designed to heat a heat-receiving fluid by means of reaction heat of fuel gas. The heat exchanger has catalytic layers that are provided on outer peripheries of the heat-receiving fluid passages and cause an exothermic reaction upon contact with fuel gas. A large number of heat-receiving fluid passages are disposed across the fuel gas passage. Heat-receiving fluid in a passage connecting the heat-receiving fluid passages with one another flows in a direction opposite to the flow of fuel gas, and the heat-receiving fluid passages are smaller in diameter on an upstream side of the fuel gas passage where heat-receiving fluid is gaseous than on a downstream side of the fuel gas passage where heat-receiving fluid is liquid or at its boiling point, and the heat-receiving fluid passages are arranged more densely on the upstream side than on the downstream side.

In the aforementioned construction, on the upstream side of the fuel gas passage where heat-receiving fluid is gaseous and at a high temperature, the heat-receiving fluid passages are smaller in diameter than on the downstream side. Thus, the flow cross-sectional area of the heat-receiving fluid decreases in proportion to the square of the diameter of the heat-receiving fluid passages, and the flow rate of the heat-receiving fluid flowing in the heat-receiving fluid passages increases. By increasing the flow rate, the heat transfer performance can be improved, whereby the heat exchange efficiency can be enhanced. Also, the exothermic area decreases in proportion to the diameter of the heat-receiving fluid passages. However, the heat-receiving fluid passage are arranged densely on the upstream side, and the number of the heat-receiving fluid passages to be provided on the upstream side is increased so as to enlarge a total surface area thereof. Thus, a necessary exothermic area can be ensured. In this case, even if the number of the heat-receiving fluid passages to be provided has been increased, the heat-receiving fluid has been converted from liquid into gas and has thereby increased in volume drastically. Therefore, there is no possibility of heat-receiving fluid being kept from flowing into part of the heat-receiving fluid passages owing to vapor lock or flow deviation. Accordingly, the fins and the heat-receiving fluid passages can be securely prevented from being overheated.

In the fifth aspect of the present invention, the oxidation catalytic layers may be formed directly on outer surfaces of the heat-receiving fluid passages on an upstream side of the fuel gas passage where heat-receiving fluid is gaseous, and are formed on outer surfaces of fins bonded to outer peripheries of the heat-receiving fluid passages on a downstream side of the fuel gas passage where heat-receiving fluid is liquid or at its boiling point.

Thus, the fins and the heat-receiving fluid passages can be securely prevented from being overheated, and a required exothermic area can be ensured by increasing the number of heat-receiving fluid passages to be provided. Further, the relatively small number of fins are not bonded to the heat-receiving fluid passages on the upstream side. Hence, there is no need to prepare fins that have a dimension suited for the diameter of the heat-receiving fluid passages on the upstream side. For this reason, the number of parts can be reduced, and the overall manufacturing costs can be lowered. Furthermore, even if the same amount of heat is generated, the amount of heat transmitted to the fuel gas can be reduced by eliminating the fins, in comparison with the case where the fins are provided.

DETAILED DESCRIPTION OF THE PREFERRED EMBODIMENTS

Figure 1:
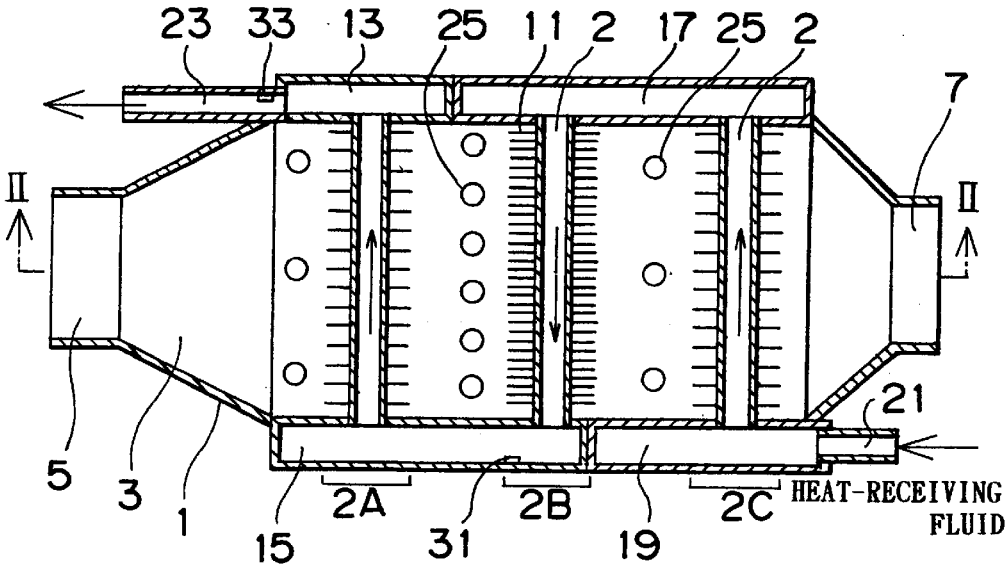
FIG. 1 is an entire cross-sectional view of a catalytic combustion heater according to a first embodiment of the present invention.
Figure 2:
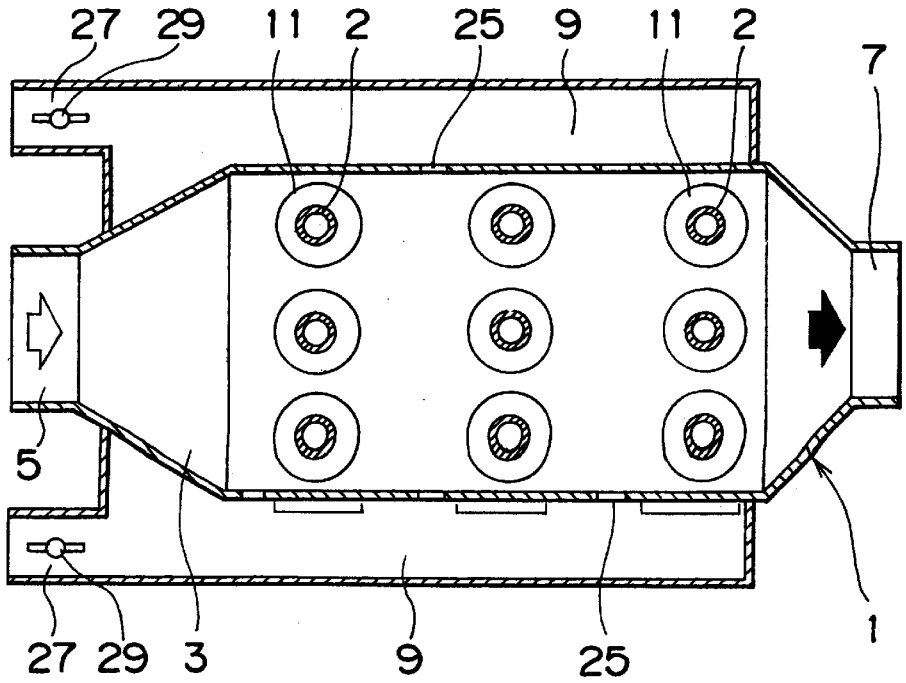
FIG. 2 is a cross-sectional view taken along line II—II of the catalytic combustion heater shown in FIG. 1.

A catalytic combustion heater according to a first embodiment of the present invention will be described hereinafter with reference to FIGS. 1 and 2. FIGS. 1 and 2 are cross-sectional views of the catalytic combustion heater and show a cylindrical container 1, which is open at its both ends and has a fuel gas passage 3 formed therein. Fuel gas is a mixture of combustible gas and combustion support gas. For example, hydrogen, methanol or the like is used as combustible gas, and air or the like is used as combustion support gas. Provided at left and right end portions of the container 1 are a combustion support gas feed port 5 and an exhaust port 7 respectively. As indicated by arrows in FIG. 2, combustion gas flows through the fuel gas passage 3 in a left-to-right direction. Formed at each lateral portion of the container 1 is a combustible gas feed portion 9, which will be described later.

Multiple tubes 2, through which heat-receiving fluid flows, extend in the fuel gas passage 3 in a direction perpendicular to the flow of fuel gas (a vertical direction in FIG. 1). These tubes 2 are arranged in parallel with one another and layered in the flow direction of fuel gas (see FIG. 2). Referring to FIG. 1, the tubes 2 are provided in three layers 2A through 2C. Multiple ring-like fins 11 are integrally bonded to an outer periphery of each of the tubes 2 using wax or the like. Carried on an outer surface of each of the fins 11 is an oxidation catalyst such as platinum, palladium or the like using a carrier made of a porous substance such as alumina or the like.

The tubes 2 constituting the most upstream layer 2A are in communication with one another through fluid reservoirs 13 and 15, which are provided at one end and at the other end of the tubes 2 respectively (see FIG. 1). Similarly, the intermediate layer 2B communicates with the fluid reservoirs 15 and a fluid reservoir 17, and the most downstream layer 2C communicates with the fluid reservoirs 17 and a fluid reservoir 19. An inlet pipe 21 for heat-receiving fluid is connected with the fluid reservoir 19, and an outlet pipe 23 is connected with the fluid reservoir 23. As a result, there is formed a passage of heat-receiving fluid that flows upstream and zigzag in the fuel gas passage 3, as is apparent from the arrows in the drawings. For example, water is used as the heat-receiving fluid. In flowing through the passage, this heat-receiving fluid is heated to a high temperature due to oxidation reaction heat of fuel gas, reaches its boiling point and then becomes gaseous. In this case, for example, the flow rate, heat release value, and the like, of heat-receiving fluid are controlled such that the heat-receiving fluid becomes liquid in the most downstream layer 2C, gets boiled in the intermediate layer 2B, and becomes gaseous in the most upstream layer 2A.

In this embodiment, the combustible gas feed portion 9, which has multiple combustible gas feed ports 25 in the form of fuel feed ports, is provided at each of the respective lateral portions of the container 1. The combustible gas feed portion 9 serves as fuel distribution means for distributing fuel gas to the respective layers 2A through 2C of the tubes 2. The fuel gas corresponds in amount to a state of the heat-receiving fluid flowing in the tubes 2. The multiple combustible gas feed ports 25 penetrate both lateral walls of the container 1 and open to the fuel gas passage 11 (see FIG. 2). These combustible gas feed ports 25 are formed, in a predetermined number, upstream of each of the layers 2A through 2C of the tubes 2 so as to separately supply the respective layers with combustible gas (see FIG. 1). The number of the combustible gas feed ports 25 corresponding to each of the layers 2A through 2C is suitably determined such that a necessary amount of combustible gas is supplied to each of the layers in accordance with a state of the heat-receiving fluid therein. The heat-receiving fluid exhibits a high heat transfer rate at its boiling point, and necessitates a large amount of heat for gasification. Thus, more combustible gas feed ports 25 are formed upstream of the intermediate layer 2B where the heat-receiving fluid is at its boiling point, than upstream of the other layers.

The combustible gas feed portion 9 is connected at one end (at the left end in FIG. 2) with a combustible gas inlet pipe 27, and is closed at the other end. Disposed in the combustible gas inlet pipe 27 is a throttle valve 29 (see FIG. 2), which serves as fuel reduction means for reducing a feed rate of fuel gas if the heat-receiving fluid has become gaseous where it should remain at its boiling point. By adjusting an opening degree of the throttle valve 29, the amount of combustible gas introduced into the combustible gas feed portion 9 can be reduced. Further, a temperature sensor 31, which serves as temperature detection means, is provided in the fluid reservoir 15 where the heat-receiving fluid flowing therein should constantly remain at its boiling point. The opening degree of the throttle valve 29 can be adjusted in accordance with a state of heat-receiving fluid judged from a temperature thereof.

Furthermore, according to this embodiment, the fins, which are formed on the outer periphery of each of the tubes 2, are arranged at shorter intervals in the intermediate layer 2B where the heat-receiving fluid flowing therein is at its boiling point, than in the other layers (see FIG. 1). Thus, the exothermic area of the intermediate layer 2B can be increased so as to further increase the heat release value thereof. In this embodiment, the diameter and number of the tubes 2 and the diameter, shape and the like of the fins 11 are uniformly determined. However, these factors can be suitably changed in accordance with an amount of heat necessary for the heat-receiving fluid in the tubes 2 to be connected.

Figure 9:
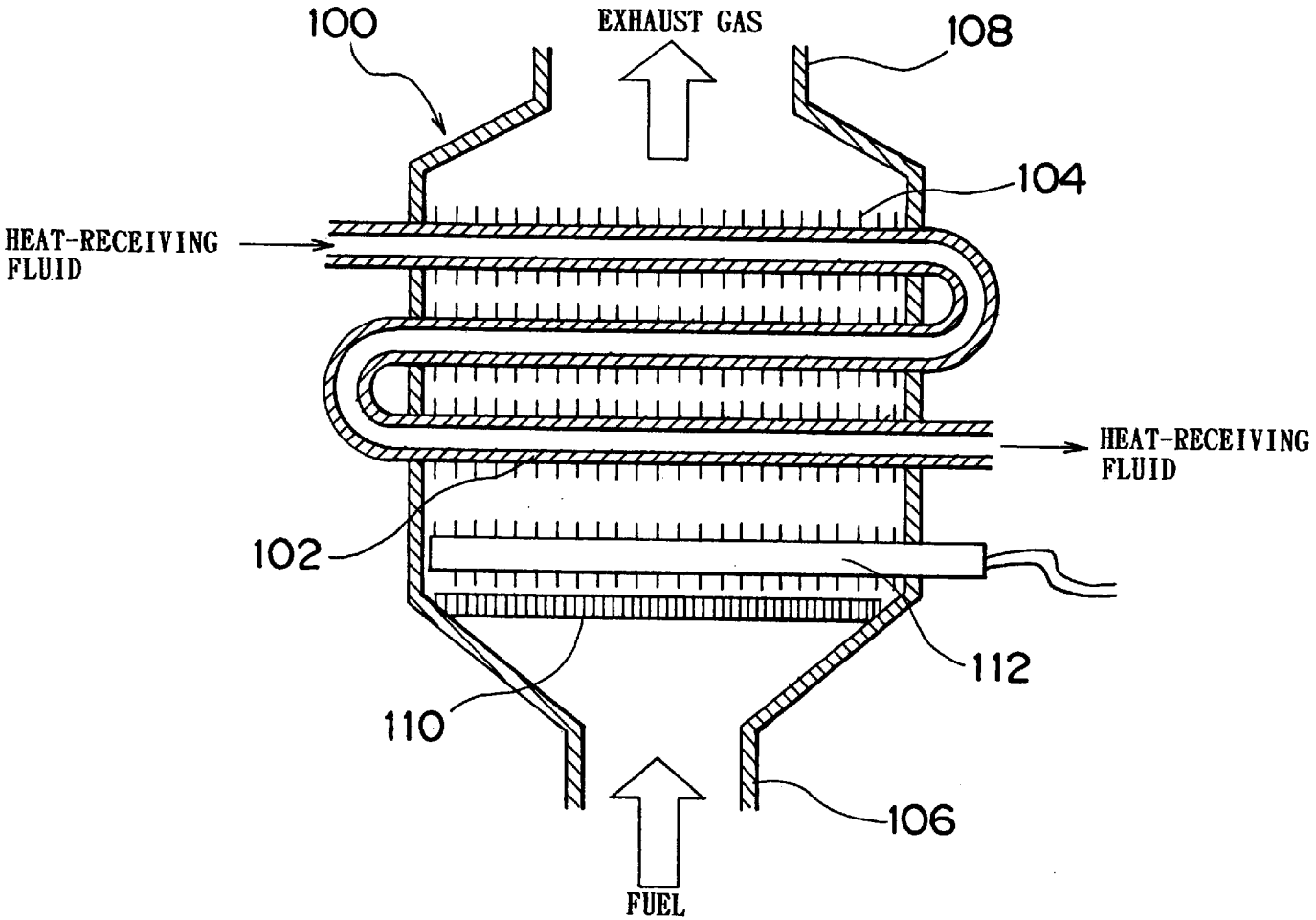
FIG. 9 RELATED ART
FIG. 9 is a cross-sectional view of a catalytic combustion heater.

Hence, there is formed a passage of heat-receiving fluid in the fuel gas passage 3 of the container 1. According to this passage, the heat-receiving fluid enters the inlet pipe 21, flows through the tubes 2 and the fluid reservoirs 13, 15, 17 and 19, and exits at the outlet pipe 23. Secured to a wall of the outlet pipe 23 for heat-receiving fluid is a temperature sensor 33 for controlling an outlet temperature of the heat-receiving fluid. In the fuel gas passage 3, a current plate having multiple perforations or a catalytic heater as shown in FIG. 9 can be provided in the vicinity of a combustion support gas feed port 12.

The operation of the catalytic combustion heater according to this embodiment will now be described. In the aforementioned construction, combustion support gas is supplied to the fuel gas passage 3 from the combustion support gas feed port 5. This combustion support gas is mixed with combustible gas, which is supplied from the combustible gas feed portions 9 through multiple combustible gas feed ports 25. The thus-mixed gas is then supplied to the respective layers of the tubes 2, causes an oxidation reaction with the catalyst on the fins, undergoes catalytic combustion, and flows towards the exhaust port 7 (in the left-to-right direction in the drawings). The heat generated by the oxidation reaction is transmitted from the fins 11 to the tubes 2, so as to heat the heat-receiving fluid flowing in the tubes 2.

On the other hand, contrary to the flow of fuel gas, the heat-receiving fluid flows through the tubes 2 via the fluid reservoirs 13, 15, 17 and 19, in the right-to-left direction in the drawing. As the heat-receiving fluid approaches the upstream side of the fuel gas passage 3, the temperature thereof becomes higher. The heat-receiving fluid reaches its boiling point in the intermediate layer 2B, where a large amount of heat is required to gasify the heat-receiving fluid. Further, since the heat-receiving fluid is at its boiling point, the intermediate layer 2B has a minimum heat transfer resistance. In view of this, according to this embodiment, multiple combustible gas feed ports 25 corresponding to the respective layers of the tubes 2 are provided to separately supply the respective layers 2A through 2C with fuel gas. Particularly, more combustible gas feed ports 25 are provided in correspondence with the intermediate layer 2B than the other layers. Consequently, a large amount of fuel gas is supplied to the intermediate layer 2B, and a large amount of heat is generated therein. Also, the fins 11 are arranged at shorter intervals in the intermediate layer 2B than in the other layers, so that the intermediate layer 2B has a large exothermic area per unit length of the tubes 2. Thus, more heat is generated in the intermediate layer 2B than the other layers. Furthermore, in a conventional case where preliminarily mixed fuel gas is supplied to the most upstream layer 2A, the fuel gas exhibits a comparatively high concentration of combustible gas. For this reason, there is a tendency for the most upstream layer 2A to generate a relatively large amount of heat. However, according to this embodiment, the number of combustible gas feed ports 25 to be provided is set in accordance with a required heat release value, whereby the fins 11 and the tubes 2 can be prevented from being overheated. As a result, the overall enhancement in security is accomplished, and inconveniences such as deformation of the fins and the stripping of catalyst are obviated.

As described hitherto, multiple combustible gas feed ports 25 are provided, and the number of the combustible gas feed ports 25 are suitably set in accordance with a state of heat-receiving fluid. Consequently, it is possible to obtain a catalytic combustion heater that is compact, safe and high in heat exchange efficiency.

In addition, according to the above-described construction, the temperature sensor 31 is disposed in the fluid reservoir 15 where the heat-receiving fluid flowing therein should constantly remain at its boiling point, and the throttle valve 29 is disposed in the combustible gas inlet pipe 27. Thus, the flow rate of combustible gas can be suitably controlled in accordance with a state of the heat-receiving fluid. Accordingly, even if the heat-receiving fluid in the fluid reservoir 15 has been completely gasified, for example, due to an abrupt change in flow rate, it is possible to judge a state of the heat-receiving fluid from a temperature thereof, which is detected by the temperature sensor 31. Then, the opening degree of the throttle valve 29 is made smaller so as to reduce the flow rate of combustible gas, whereby the heat release value can be reduced. In this manner, the tubes and fins can be prevented from being overheated, which leads to further enhancement in security.

Although the catalytic combustion heater is transversely mounted in the aforementioned embodiment, a vertically mounted catalytic combustion heater may also be employed.

Figure 3:
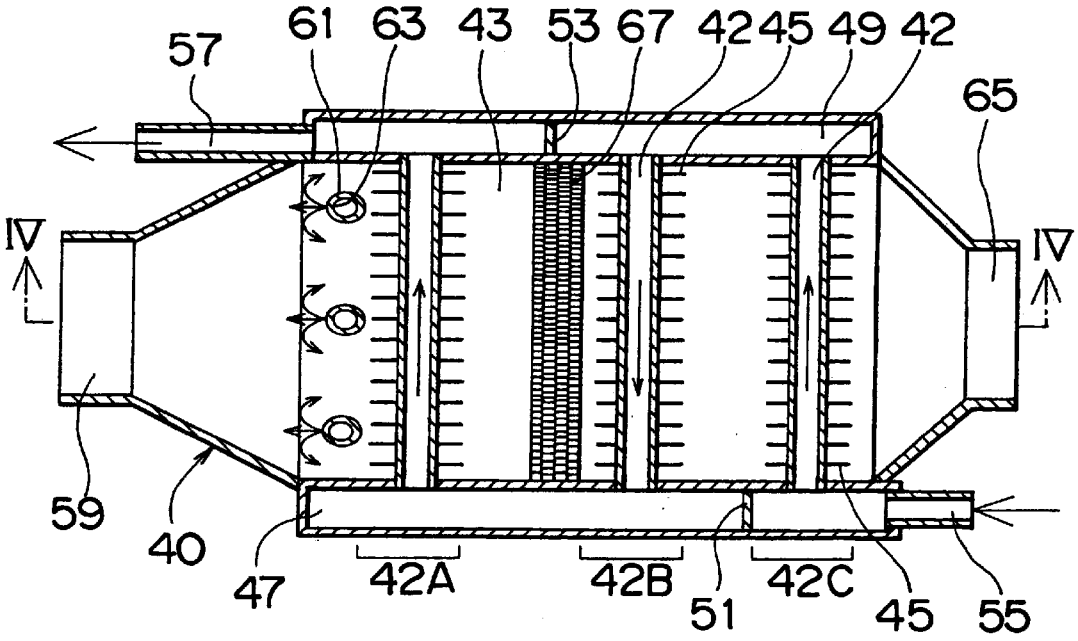
FIG. 3 is an entire cross-sectional view of a catalytic combustion heater according to a second embodiment of the present invention.
Figure 4:
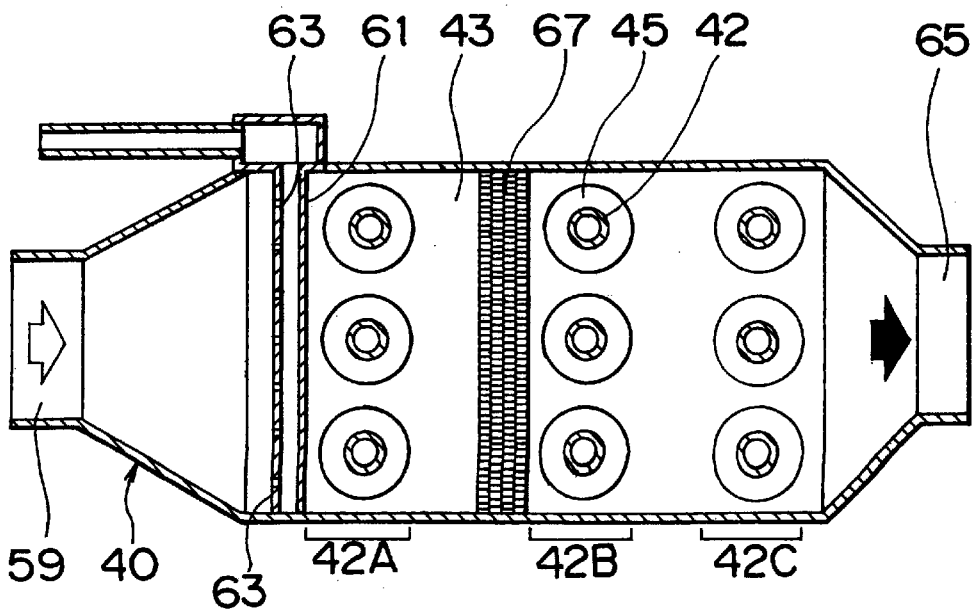
FIG. 4 is a cross-sectional view taken along line IV—IV of the catalytic combustion heater shown in FIG. 3.

A catalytic combustion heater according to a second embodiment of the present invention will be described hereinafter with reference to FIGS. 3 and 4. FIGS. 3 and 4 are cross-sectional views of a catalyst-based heat exchanger constituting a main part of the catalytic combustion heater. A cylindrical container 40, which is open at its both ends, has a fuel gas passage 43 formed therein. Fuel gas, which is composed of combustible gas and combustion support gas, flows through the fuel gas passage 43 in the left-to-right direction, as indicated by arrows in FIG. 4. Multiple tubes 42, through which heat-receiving fluid flows, extend in the fuel gas passage 43 in a direction perpendicular to the flow of fuel gas (a vertical direction in FIG. 3). These tubes 42 are arranged in parallel with one another and are layered in the flow direction of fuel gas (see FIG. 4). Referring to FIGS. 3 and 4, the tubes 42 are provided in three layers 42A through 42C.

Multiple ring-like fins 45 are integrally bonded to an outer periphery of each of the tubes 42 using wax or the like. Formed on a surface of each of the fins 45 is an oxidation catalyst layer, which is composed of an oxidation catalyst such as platinum, palladium or the like carried by a carrier made of a porous substance such as alumina or the like. Upon contact with fuel gas, the oxidation catalyst layer causes an oxidation reaction. The heat generated by the oxidation reaction is transmitted from the fins 45 to the tubes 42, so as to heat the heat-receiving fluid flowing in the tubes 42.

In this embodiment, the diameter and number of the fins 45 to be provided on the outer periphery of each of the tubes 42 are uniformly determined in all the layers. However, these factors can be suitably changed in accordance with a required heat release value or the like. Also, the number, arrangement, and the like, of the tubes 42 may be suitably set in accordance with a flow rate or a state of the heat-receiving fluid.

Each of the tubes 42 communicates at one end with a fluid reservoir 47 provided in a lower portion of the container 40, and communicates at the other end with a fluid reservoir 49 provided in an upper portion of the container 40. The fluid reservoirs 47 and 49 are divided into a plurality of sections by partitions 51 and 53 respectively. An inlet pipe 55 for heat-receiving fluid is connected with the lower fluid reservoir 47 at its right end, and an outlet pipe 57 for heat-receiving fluid is connected with the upper fluid reservoir 49 at its left end. As a result, there is formed a passage of heat-receiving fluid that flows upstream and zigzag in the fuel gas passage 43. According to this passage, the heat-receiving fluid enters the inlet pipe 55, flows through the respective layers 42A through 42C of the tubes 2 and the fluid reservoirs 47 and 49, and exits at the outlet pipe 57.

For example, water is used as the heat-receiving fluid. In flowing through the passage, this heat-receiving fluid is heated to a high temperature due to oxidation reaction heat of fuel gas. In this case, for example, the respective layers 42A through 42C of the tubes 42 function as follows. For example, the layer 42C, which is located downstream in the fuel gas passage 43, functions as a heat-up portion for heat-receiving fluid. The intermediate layer 42B functions as a liquid boiling portion, and the upstream layer 42A functions as a gas heat-up portion.

In this embodiment, in the upstream layer 42A where the heat-receiving fluid flowing in the tubes exhibits a high heat transfer resistance, combustible gas and combustion support gas that constitute fuel gas are separately introduced into the fuel gas passage 43. This serves as means for making inhomogeneous a mixture state of combustible gas and combustion support gas contained in the fuel gas supplied to the periphery of each of the tubes 42. That is, a combustion support gas feed port 59 for supplying combustion support gas is provided at a left end portion of the container 40, and a plurality of combustible gas feed pipes 61 for supplying combustible gas are disposed in the vicinity of the upstream side of the upstream layer 42A of the tubes 42. The combustible gas feed pipes 61 extend in parallel with one another across the fuel gas passage 43, in a direction perpendicular to the tubes 42 (a vertical direction in FIG. 4). A plurality of combustible gas feed ports 63 open to the tube walls on the upstream side of fuel gas flow. The combustible gas introduced into the fuel gas passage 43 through these combustible gas feed ports 63 is then mixed with combustion support gas and flows downstream. Provided at a right end portion of the container 40 is an exhaust port 65, through which exhaust gas is discharged outside after catalytic combustion. For example, hydrogen, methanol or the like is used as combustible gas, and air or the like is used as combustion support gas.

Furthermore, a diffuser plate 67 is disposed across the fuel gas passage 43 in the vicinity of the upstream side of the intermediate layer 42B where the heat-receiving fluid flowing in the tubes 42 exhibits a low heat transfer resistance. The diffuser plate 67 has multiple perforations for diffusing the flow of gas and serves as means for making homogeneous a mixture state of combustible gas and combustion support gas contained in the fuel gas supplied to the periphery of the tubes 42. The diffuser plate 67, which is made, for example, of foam metal, metal wool or the like, is effective in promoting the mixing of combustible gas and combustion support gas so as to facilitate catalytic combustion of fuel gas on the surfaces of the fins 45 provided on the outer peripheries of the tubes 42. Instead of the diffuser plate 67, a diffuser member of any type can be employed as long as it has the effect of diffusing the flow of gas. For example, a porous piece of sintered metal, a single piece of punching metal, or a plurality of punched metal pieces of different opening diameters arranged in parallel with one another may also be employed.

The operation of the catalytic combustion heater of the aforementioned construction will now be described. Water, which is the heat-receiving fluid, is supplied to the passage of heat-receiving fluid from the inlet pipe 55. The water then flows in the tubes 42 in a direction opposite to the flow of fuel gas (in a right-to-left direction in the drawings) via the fluid reservoirs 47 and 49. Meanwhile, the heat-receiving fluid is gradually heated due to oxidation reaction heat of fuel gas, and reaches its highest temperature in the upstream layer 42A in the fuel gas passage 43. In the upstream layer 42A, the heat-receiving fluid flowing through the tubes 42 is vapor of a high temperature and exhibits a large heat transfer resistance. Besides, the concentration of combustible gas is high on the upstream side of fuel gas. For this reason, according to the conventional construction, the tubes 42 and the fins 45 provided on the outer periphery thereof tend to reach a high temperature.

In view of this, according to this embodiment, a combustible gas feed pipe 61 is disposed in the vicinity of the upstream side of the upstream layer 42A, so that combustible gas is mixed with combustion support gas immediately before being supplied to the tubes 42 of the upstream layer 42A. Thus, the mixture state of fuel gas is made inhomogeneous on the upstream side of the fuel gas passage 43, so as to cause a partial deficiency in oxygen. Thus, the heat release value can be reduced in accordance with an amount of heat necessary for the heat-receiving fluid flowing in the tubes 42. Therefore, the fins 45 and the tubes 42 are prevented from being excessively overheated, so that the overall enhancement in security as well as high heat transfer efficiency can be achieved.

Furthermore, in the intermediate layer 42B where the heat-receiving fluid is at its boiling point and exhibits a small heat transfer resistance, the diffuser plate 67 is disposed in the vicinity of the upstream side of the corresponding tubes 42. Hence, fuel gas contacts the oxidation catalyst layers on the surfaces of the fins 45 after being diffused and mixed sufficiently. Accordingly, the combustion of fuel gas is facilitated, whereby a large amount of catalytic reaction heat can be obtained and heat transfer performance can be improved. In addition, since fuel gas is homogeneously mixed, the whole combustion process proceeds under good conditions. Therefore, it is possible to inhibit unburnt gas from being discharged, and even upon activation of the heater, low-emission operation can be performed.

Figure 5:
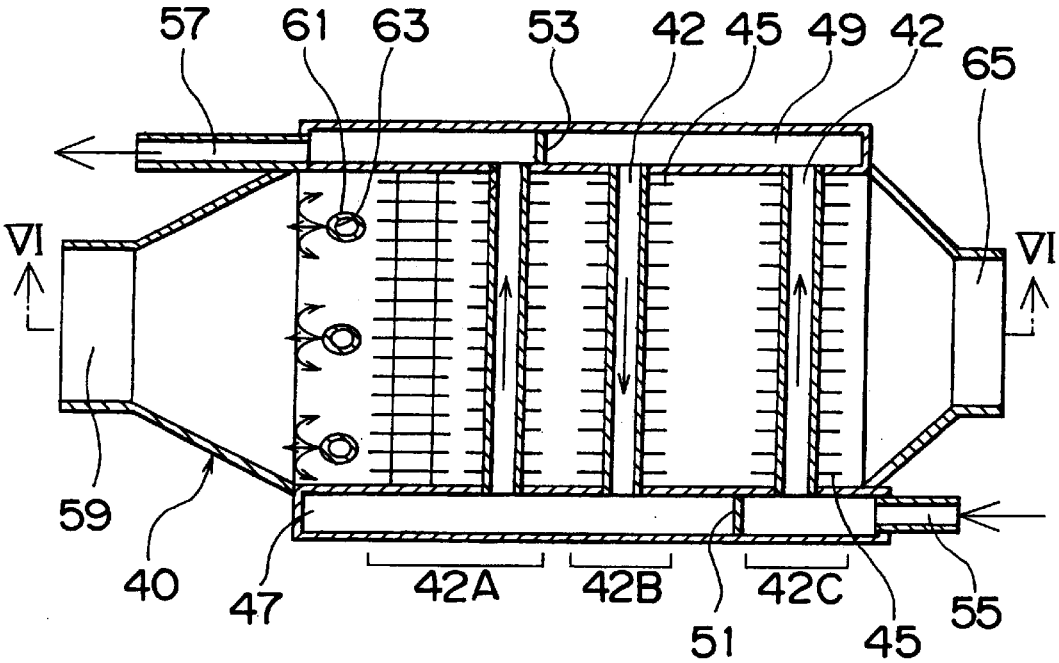
FIG. 5 is an entire cross-sectional view of a catalytic combustion heater according to a third embodiment of the present invention.
Figure 6:
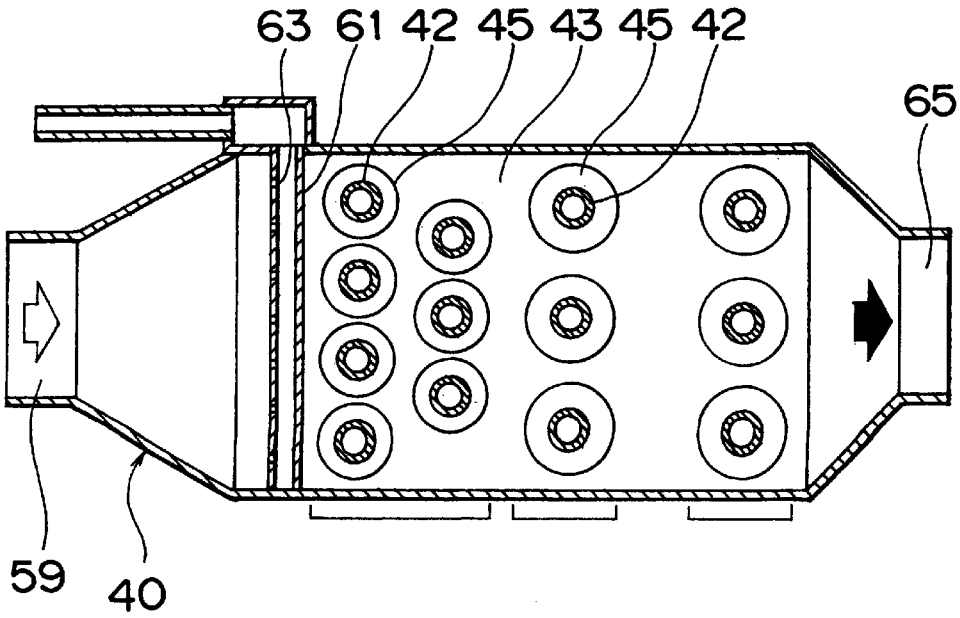
FIG. 6 is a cross-sectional view taken along line VI—VI of the catalytic combustion heater shown in FIG. 5.

FIGS. 5 and 6 show a third embodiment of the present invention. This embodiment dispenses with the diffuser plate 67. That is, in the intermediate layer 42B where the heat-receiving fluid flowing in the tubes exhibits a low heat transfer resistance, the tubes 42 located upstream of the diffuser plate 67 of the second embodiment are arranged in two rows, and the tubes 42 in one row are offset relative to the tubes 42 in the other row. This is means for making homogeneous a mixture state of combustible gas and combustion support gas contained in the fuel gas supplied to the peripheries of the tubes 42. This construction makes it possible to achieve a similar effect of diffusing the flow of fuel gas and facilitating the mixing thereof. In this case, more tubes 42 and fins 45 are provided in the upstream layer 42A than in the other layers. Therefore, in order to suitably adjust the reaction areas, the surface area of the fins 45 is set smaller on the upstream side than on the downstream side. As for the other details of construction, the third embodiment is identical to the above-described first embodiment.

As described above, according to the present invention, the fins 45 and the tubes 42 are prevented from being overheated, so that stable catalytic combustion and high heat exchange efficiency can be achieved. Furthermore, in the case where gas with a high diffusion coefficient such as hydrogen is used, the gas is introduced separately from combustion support gas, as in the aforementioned construction. Thus, it is possible to prevent flash back and realize a high-quality catalytic combustion heater without necessitating a complicated mechanism such as a fuel throttle mechanism or the like.

Figure 7:
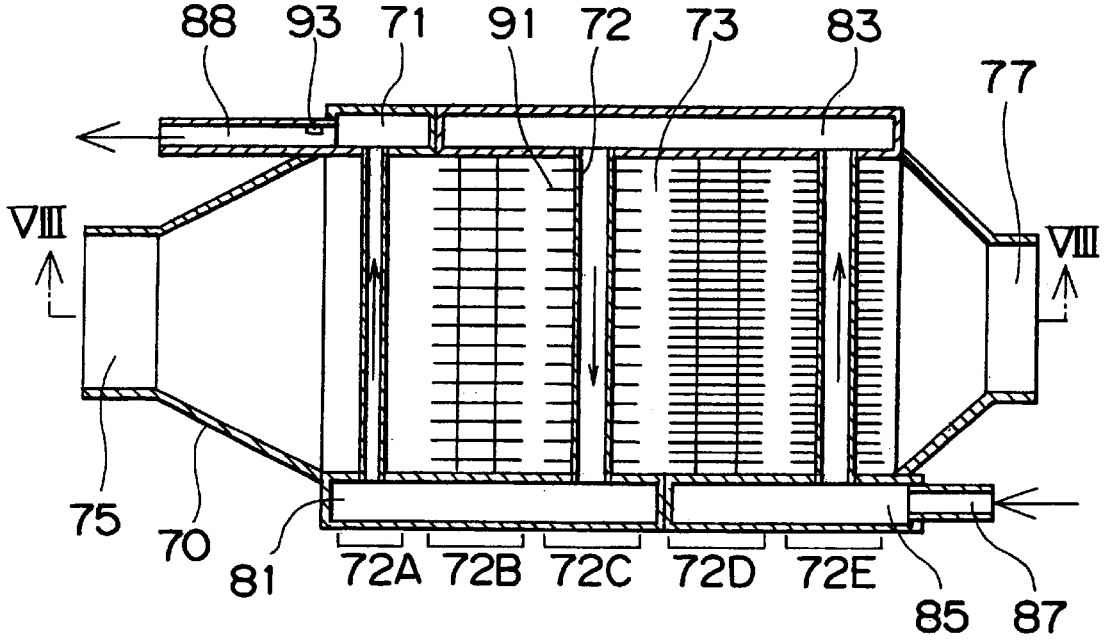
FIG. 7 is an entire cross-sectional view of a catalytic combustion heater according to a fourth embodiment of the present invention.
Figure 8:
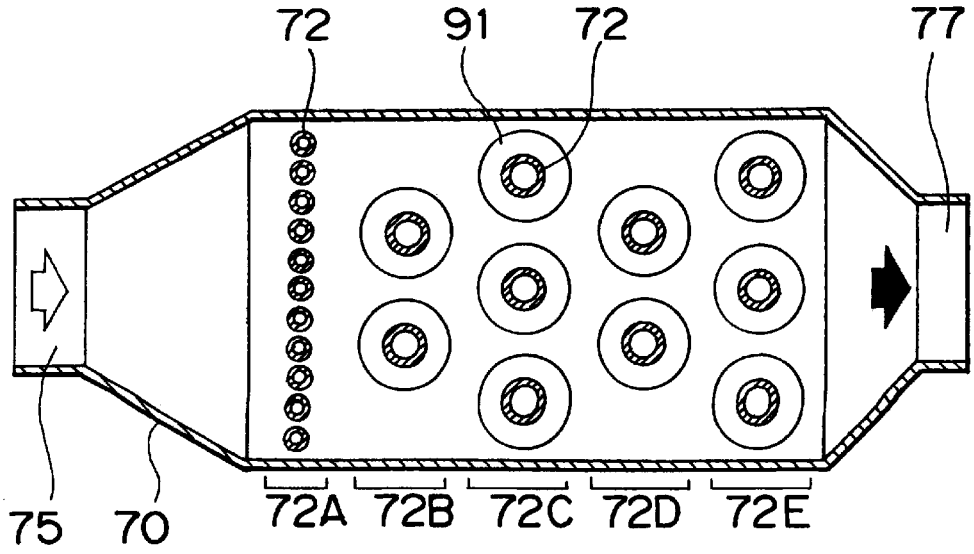
FIG. 8 is a cross-sectional view taken along line VIII—VIII of the catalytic combustion heater shown in FIG. 7.

A catalytic combustion heater according to a fourth embodiment of the present invention will be described hereinafter with reference to FIGS. 7 and 8. FIGS. 7 and 8 are cross-sectional views of a catalyst-based heat exchanger constituting a main part of the catalytic combustion heater. A cylindrical container 70, which is open at its both ends, has a fuel gas passage 73 formed therein. Provided at left and right end portions of the container 70 are a fuel feed port 75 and an exhaust port 77 respectively. Fuel gas flows through the fuel gas passage 73 in the left-to-right direction, as indicated by arrows in FIG. 8. Fuel gas is composed of, for example, a mixture of combustible gas such as hydrogen, methanol, or the like, and air. Combustible gas and air are supplied to the fuel gas passage 73 as fuel gas, after being mixed with each other in a gas feed portion (not shown).

Multiple tubes 72, through which heat-receiving fluid flows, extend in the fuel gas passage 73 in a direction perpendicular to the flow of fuel gas (a vertical direction in FIG. 7). These tubes 72 are arranged in parallel with one another and layered in the flow direction of fuel gas (see FIG. 8). Referring to FIGS. 7 and 8, the tubes 72 are provided in five layers 72A through 72E.

The tubes 72 constituting the most upstream layer 72A are in communication with one another through fluid reservoirs 71 and 81, which are provided at opposite end portions of the most upstream layer 72A (see FIG. 7). Similarly, the intermediate layers 72B and 72C are connected with the fluid reservoirs 83 and 81, and the downstream layers 72D and 72E are connected with the fluid reservoirs 83 and 85. An inlet pipe 87 for heat-receiving fluid is connected with the fluid reservoir 85, and an outlet pipe 88 is connected with the fluid reservoir 71. As a result, there is formed a passage of heat-receiving fluid that flows upstream and zigzag in the fuel gas passage 73, as is apparent from the arrows in the drawings. For example, water is used as heat-receiving fluid. In flowing through the passage, this heat-receiving fluid is heated to a high temperature due to oxidation reaction heat of fuel gas, reaches its boiling point and then becomes gaseous. In this case, for example, the flow rate, heat release value and the like of heat-receiving fluid are controlled such that the heat-receiving fluid becomes liquid in the most downstream layers 72D and 72E, gets boiled in the intermediate layers 72B and 72C, and becomes gaseous in the most upstream layer 72A.

Except for the most upstream layer 72A of the fuel gas passage 73, multiple ring-like fins 91 are integrally bonded to an outer periphery of each of the tubes 72 using wax or the like. Carried on outer surfaces of the tubes 72 and the fins 91 are oxidation catalyst layers such as platinum, palladium or the like using a carrier made of a porous substance such as alumina or the like. In this embodiment, the fins 91 are not bonded to the tubes 72 of the most upstream layer 72A. Oxidation catalyst layers are formed directly on the outer surfaces of the tubes 72.

Furthermore, according to this embodiment, the tubes 72 constituting the most upstream layer 72A are smaller in diameter than the tubes 72 located downstream of the most upstream layer 72A. Also, the tubes 72 of the most upstream layer 72A are arranged more densely than the tubes 72 of the downstream layers 72B through 72E. In other words, the number of the tubes 72 constituting the most upstream layer 72A is larger than the number of the tubes 72 constituting each of the downstream layers 72B through 72E. The construction wherein the tubes 72 of the most upstream layer 72A are not provided with the fins 91 and relatively small in diameter contributes to the reduction of the exothermic area thereof. Therefore, in compensation, the number of the tubes 72 of the most upstream layer 72A is set large so as to increase the total outer surface area and to thereby ensure a necessary exothermic area. Moreover, in the most upstream layer 72A, the heat-receiving fluid flowing in the tubes 72 is gaseous and therefore exhibits a low heat transfer rate. For this reason, the number of the tubes 72 is increased in the most upstream layer 72A, with a view to accelerating the flow of the heat-receiving fluid and improving heat transfer performance.

In the downstream layers 72B through 72E, the diameter of the tubes 72 and the diameter, shape and the like of the fins 91 are uniformly determined. Further, the tubes 72 of the downstream layers 72B, 72C and 72D are offset relative to the tubes 72 of the downstream layers 72C, 72D and 72E respectively. Hence, the actual length of the fuel gas passage is increased. Still further, the fins 91 are arranged at relatively small intervals in the two most downstream layers 72D and 72E. In other words, more fins 91 are provided in the downstream layers 72D and 72E than the other layers, so as to increase the overall exothermic area (see FIG. 7). The outer diameter, number and the like of the fins 91 can be suitably set in accordance with an amount of heat necessary for the heat-receiving fluid in the tubes 72 to which those fins 91 are bonded. Besides, the number, arrangement and the like of the tubes 72 may be suitably set in accordance with a flow rate and a state of the heat-receiving fluid.

Hence, there is formed a passage of heat-receiving fluid in the fuel gas passage 73 of the container 70. According to this passage, the heat-receiving fluid enters the inlet pipe 87, flows through the tubes 72 and the fluid reservoirs 71, 81, 83 and 85, and exits through the outlet pipe 88. Secured to a tube wall of the outlet pipe 88 for heat-receiving fluid is a temperature sensor 93 for controlling an outlet temperature of the heat-receiving fluid. In the fuel gas passage 73, a current plate having multiple perforations or a catalytic heater as shown in FIG. 9 can be provided in the vicinity of the combustion support gas feed port 75.

In the aforementioned construction, fuel gas, which is a mixture of combustible gas and air, is supplied to the fuel gas passage 73 from the fuel feed port 75, causes an oxidation reaction with the catalyst on the fins 91, undergoes catalytic combustion, and flows towards the exhaust port 77 (in the left-to-right direction in the drawings). The heat generated by the oxidation reaction is transmitted from the fins 91 to the tubes 72, so as to heat the heat-receiving fluid flowing in the tubes 72. On the other hand, contrary to the flow of fuel gas, the heat-receiving fluid flows through the tubes 72 via the fluid reservoirs 71, 81, 83 and 85, in the right-to-left direction in the drawing. As the heat-receiving fluid approaches the upstream side of the fuel gas passage 73, the temperature thereof becomes higher. The heat-receiving fluid then reaches its boiling point, becomes gaseous and enters the tubes 72 of the most upstream layer 72A.

Thus, in the case where heat-receiving fluid flows in the direction opposite to the flow of fuel gas, the heat-receiving fluid reaches its highest temperature when flowing in the tubes 72 in close proximity to the fuel feed port 75. For this reason, these tubes 72 and the fins 91 provided thereon tend to be heated to a high temperature. However, according to the aforementioned construction, the tubes 72 are not provided with the fins 91 in the most upstream layer 72A of the fuel gas passage 73, so that the fins 91 and the tubes 72 are prevented from being heated to an excessively high temperature. Thus, it is possible to obviate a problem such as deformation of the fins 91 resulting from thermal stress in the radial direction of the tubes 72 or the stripping of the catalyst. There is no possibility of the fins 91 acting as cooling fins. Furthermore, the diameter of the tubes 72 of the most upstream layer 72A is made relatively small, and the number of the tubes 72 to constitute the most upstream layer 72A is increased. Thus, the heat release value is controlled appropriately and prevented from becoming excessively great. Moreover, since the flow rate of the heat-receiving fluid flowing in the tubes 72 of the most upstream layer 72A increases, it is possible to enhance thermal conductivity.

On the other hand, as the heat-receiving fluid approaches the downstream side of the fuel gas passage 73, that is, the exhaust port 77, the temperature thereof becomes lower. Hence, the exhaust gas discharged from the exhaust port 77 is brought into contact with the tubes 72 in which heat-receiving fluid of a relatively low temperature flows. In this manner, the heat of exhaust gas can be reused efficiently. Further, because the tubes 72 constituting one layer are offset relative to the tubes 72 constituting the next layer, the actual length of the fuel gas passage 73 is increased. As a result, heat exchange efficiency is enhanced. Accordingly, the dimension of the container 70 in the flow direction of fuel gas can be reduced so as to make the catalytic combustion heater compact.

Furthermore, the fins 91 are arranged at small intervals on the downstream side so as to increase contact areas of the fins 91 with exhaust gas. Thus, the heat of exhaust gas can be reused effectively, and the exhaust gas can be cleaned completely by subjecting unburnt fuel gas to catalytic combustion.

As described above, according to this embodiment, the fins 91 and the tubes 72 are prevented from being overheated, so that stable catalytic combustion and high heat exchange efficiency can be achieved.

Although the catalytic combustion heater is transversely mounted in the aforementioned embodiment, a vertically mounted catalytic combustion heater may also be employed.

While the present invention has been described with reference to what are presently considered to be preferred embodiments thereof, it is to be understood that the present invention is not limited to the disclosed embodiments or constructions. On the contrary, the present invention is intended to cover various modifications and equivalent arrangements. In addition, while the various elements of the disclosed invention are shown in various combinations and configurations, which are exemplary, other combinations and configurations, including more, less or only a single embodiment, are also within the spirit and scope of the present invention.

What is claimed is:

1. A catalytic combustion heater comprising:

a container forming a fuel gas passage;

heat-receiving fluid passages in which a heat-receiving fluid flows, said heat-receiving fluid passages being disposed in said fuel gas passage;

a catalyst-based heat exchanger for heating a heat-receiving fluid by a reaction heat of a fuel gas, said heat exchanger being disposed in said fuel gas passage and having catalytic layers that are provided on outer peripheries of said heat-receiving fluid passages and cause an exothermic reaction upon contact with the fuel gas; and heat amount changing means for changing an amount of heat to be supplied to the heat-receiving fluid flowing in respective portions of said heat-receiving fluid passages, in accordance with a variation in phase of said heat-receiving fluid, such that a portion of said heat-receiving fluid passages in which the heat-receiving fluid flows during a variation in the phase of the heat-receiving fluid receives a greater amount of heat than a portion of said heat-receiving fluid passages in which the heat-receiving fluid flows without a variation in the phase of the heat-receiving fluid.

2. The catalytic combustion heater according to claim 1, wherein said heat amount changing means has fuel distribution means for separately supplying fuel gas to the respective portions of said heat-receiving fluid passages in accordance with a state of the heat-receiving fluid flowing inside said heat-receiving fluid passages.

3. The catalytic combustion heater according to claim 2, wherein said fuel distribution means separately supplies said fuel gas in a larger amount to a section of said heat-receiving fluid passages where said heat-receiving fluid is at its boiling point than to the other sections of said heat-receiving fluid passages.

4. The catalytic combustion heater according to claim 2, wherein said heat-receiving fluid passages have an exothermic area per unit length that is larger in the section where the heat-receiving fluid flowing in said heat-receiving fluid passages is at its boiling point than in the other sections.

5. The catalytic combustion heater according to claim 2, further comprising:

temperature detection means for detecting a temperature of heat-receiving fluid, said temperature detection means being provided in a section of said heat-receiving fluid passages where said heat-receiving fluid should constantly remain at its boiling point; and fuel reduction means for reducing an amount of fuel gas to be supplied to said section of said heat-receiving fluid passages where said heat-receiving fluid should constantly remain at its boiling point when it is determined from a temperature of heat-receiving fluid detected by said temperature detection means that the heat-receiving fluid in said section of said heat-receiving fluid passages where said heat-receiving fluid should constantly remain at its boiling point is gaseous.

6. The catalytic combustion heater according to claim 2, wherein said fuel distribution means has multiple fuel feed ports for separately supplying fuel gas to respective portions of said heat-receiving fluid passages, said fuel feed ports being formed in a wall of said fuel gas passage, and said fuel feed ports have a total cross-sectional area that is larger in a section of said heat-receiving fluid passages where the heat-receiving fluid is at its boiling point than the other sections of said heat-receiving fluid passages.

7. The catalytic combustion heater according to claim 2, wherein said catalytic layers are composed of fins on which an oxidation catalyst is carried.

8. The catalytic combustion heater according to claim 7, wherein said fins are arranged at smaller intervals in a section of said heat-receiving fluid passages where heat-receiving fluid flowing in said heat-receiving fluid passages is at its boiling point than in the other sections of said heat-receiving fluid passages.

9. The catalytic combustion heater according to claim 2, wherein said catalyst-based heat exchanger heats the heat-receiving fluid in its liquid state and makes the heat-receiving fluid gaseous.

10. The catalytic combustion heater according to claim 2, wherein said heat-receiving fluid in said catalyst-based heat exchanger flows in a direction opposite to a flow of said fuel gas.

11. The catalytic combustion heater according to claim 2, wherein said fuel gas includes combustible gas and combustion support gas, and said fuel distribution means makes inhomogeneous a mixture state of said combustible gas and said combustion support gas included in said fuel gas supplied to the peripheries of said heat-receiving fluid passages in a region of said fuel gas passage where the heat-receiving fluid flowing in said heat-receiving fluid passages exhibits a high heat transfer resistance.

12. The catalytic combustion heater according to claim 11, wherein said fuel distribution means is composed of a feed portion of said combustion support gas that is provided at an upstream end portion of said fuel gas passage and a feed portion of said combustible gas that opens in proximity to an upstream side of said heat-receiving fluid passages corresponding to the region where the heat-receiving fluid exhibits a high heat transfer resistance.

13. The catalytic combustion heater according to claim 2, wherein said fuel gas includes combustible gas and combustion support gas, and said fuel distribution means makes homogeneous a mixture state of said combustible gas and said combustion support gas included in said fuel gas supplied to the peripheries of said heat-receiving fluid passages in a region of said fuel gas passage where the heat-receiving fluid flowing in said heat-receiving fluid passage exhibits a low heat transfer resistance.

14. The catalytic combustion heater according to claim 13, wherein said fuel distribution means is provided with a diffuser member having multiple perforations, said diffuser member being disposed across said fuel gas passage in proximity to an upstream side of said heat-receiving fluid passages corresponding to the region where heat-receiving fluid exhibits a low heat transfer resistance.

15. The catalytic combustion heater according to claim 13, further comprising:

second fuel distribution means for making inhomogeneous a mixture state of said combustible gas and said combustion support gas included in said fuel gas supplied to the peripheries of said heat-receiving fluid passages in a region of said fuel gas passage where the heat-receiving fluid flowing in said heat-receiving fluid passages exhibits a high heat transfer resistance.

16. The catalytic combustion heater according to claim 15, wherein said second fuel distribution means comprises a feed portion of said combustion support gas that is provided at an upstream end portion of said fuel gas passages and a feed portion of said combustible gas that opens in proximity to an upstream side of said heat-receiving fluid passages corresponding to the region where heat-receiving fluid exhibits a high heat transfer resistance.

17. The catalytic combustion heater according to claim 16, wherein said heat-receiving fluid in said catalyst-based heat exchanger flows in a direction opposite to a flow of said fuel gas.

18. The catalytic combustion heater according to claim 1, wherein the heat-receiving fluid in said catalyst-based heat exchanger flows in a direction opposite to a flow of said fuel gas, and wherein said catalytic layers are formed directly on outer surfaces of said heat-receiving fluid passages on an upstream side of said fuel gas passage where the heat-receiving fluid is gaseous, and are formed on outer surfaces of fins bonded to outer peripheries of said heat-receiving fluid passages on a downstream side of said fuel gas passage where the heat-receiving fluid is liquid or at its boiling point.

19. The catalytic combustion heater according to claim 18, wherein said catalytic layers are formed directly on outer surfaces of said heat-receiving fluid passages on an upstream side of said fuel gas passage where the heat-receiving fluid is gaseous, and are formed on outer surfaces of fins bonded to outer peripheries of said heat-receiving fluid passages on a downstream side of said fuel gas passage where the heat-receiving fluid is liquid or at its boiling point.

20. The catalytic combustion heater according to claim 1, wherein a large number of said heat-receiving fluid passages are disposed across said fuel gas passage, wherein the heat-receiving fluid in a passage connecting said heat-receiving fluid passages with one another flows in a direction opposite to flow of fuel gas, and wherein said heat-receiving fluid passages are smaller in diameter on an upstream side of said fuel gas passage where heat-receiving fluid is gaseous than on a downstream side of said fuel gas passage where heat-receiving fluid is liquid or at its boiling point, and said heat-receiving fluid passages are arranged more densely on said upstream side than on said downstream side.

* * * * *